United States Patent [19]

Perovetz et al.

[11] Patent Number: 4,925,491

[45] **Date of Patent: * May 15, 1990**

[54] SOLUTIONS AND CREAMS FOR SILVER PLATING AND POLISHING

[75] Inventors: Lawrence M. Perovetz, Stanmore, England; Jack Pickthall, deceased, late of Angmering-On-Sea, England; Terence Pickthall, executor, Colchester, United Kingdom

[73] Assignee: Lamerie, N.V., Jersey, Channel Islands

[ * ] Notice: The portion of the term of this patent subsequent to Jan. 17, 2006 has been disclaimed.

[21] Appl. No.: 24,307

[22] Filed: Mar. 10, 1987

Related U.S. Application Data

[63] Continuation-in-part of Ser. No. 913,491, Sep. 30, 1986, Pat. No. 4,798,626.

[51] Int. Cl.[5] ..... C23C 3/02

[52] U.S. Cl. ..... 106/1.19; 106/3; 106/1.05; 106/1.23

[58] Field of Search ..... 106/3, 1.22, 1.23, 1.05, 106/1.19; 51/293, 308, 307, 309; 252/105; 427/437, 443.11

[56] References Cited

U.S. PATENT DOCUMENTS

| | | | |
|---|---|---|---|
| 27,425 | 3/1860 | Brockett . | |
| 43,557 | 7/1864 | Weil . | |
| 65,084 | 5/1867 | Hunter . | |
| 111,945 | 2/1871 | Keane . | |
| 663,340 | 12/1900 | Gottig . | |
| 809,278 | 1/1906 | Bolsterli . | |
| 912,081 | 2/1909 | Curtin . | |
| 1,208,507 | 12/1916 | Dalby . | |
| 1,450,926 | 4/1923 | Sherow . | |
| 2,393,866 | 1/1946 | Wassell | 252/100 |
| 2,801,935 | 8/1957 | Owen | 117/35 |
| 2,976,180 | 3/1961 | Brookshire | 117/130 |
| 3,117,012 | 1/1964 | Aler | 106/8 |
| 3,294,578 | 12/1966 | Popeck | 117/130 |
| 3,425,947 | 2/1969 | Rausch | 252/105 |
| 3,723,138 | 3/1973 | Franz | 106/1 |
| 3,754,878 | 8/1973 | Burke | 51/307 |
| 3,917,885 | 11/1975 | Baker | 427/304 |
| 3,960,573 | 6/1976 | Zeblisky | 106/1 |
| 3,983,266 | 9/1976 | Bahls | 427/164 |
| 3,992,211 | 11/1976 | Skoll | 106/1 |
| 4,102,702 | 7/1978 | Bahls | 106/1.23 |
| 4,128,671 | 12/1978 | Suggs | 427/125 |
| 4,181,760 | 1/1980 | Feldstein | 427/305 |
| 4,192,686 | 3/1980 | Soltys | 106/1.23 |
| 4,270,932 | 6/1981 | Perovetz | 51/293 |

FOREIGN PATENT DOCUMENTS

| | | | |
|---|---|---|---|
| 930902 | 7/1973 | Canada . | |
| 611258 | 3/1933 | Fed. Rep. of Germany . | |
| 355518 | 11/1905 | France | 14/2 |
| 452886 | 5/1913 | France | 8/3 |
| 482895 | 5/1917 | France . | |
| 651300 | 2/1929 | France . | |
| 2157115 | 6/1973 | France . | |
| 1491 | of 1903 | United Kingdom . | |
| 327479 | 4/1930 | United Kingdom . | |
| 383726 | 11/1932 | United Kingdom . | |

OTHER PUBLICATIONS

Spon, Workshop Receipts, pp. 208–209 (1873).

Payne, "Art Metal Work With Inexpensive Equipment".

Schwahn, "Workshop Metals for Gold-and Sivers-miths", pp. 108–109 (1960).

Coulson & Trinder, Experiments For Young Chemists, 1963, p. 105.

Pharmaceutical Formulas, vol. II, 1956, pp. 387–389.

Bennett, The Chemical Formulary, 1939, pp. 403, 411–414.

The Condensed Chemical Dictionary, Tenth Edition, 1981.

*Primary Examiner*—Josephine Barr

[57] ABSTRACT

Non-toxic solutions are provided to silver plate metallic items and previously silver plated items. Solutions and creams are also provided which simultaneously silver plate and polish such items. The amount of silver generating compound is selected to either maintain or replenish the amount of silver plating on the items. Solutions are also provided to prevent staining during the silver plating and polishing.

32 Claims, No Drawings

SOLUTIONS AND CREAMS FOR SILVER PLATING AND POLISHING

This is a continuation-in-part of U.S. patent application Ser. No. 913,491, filed Sept. 30, 1986, now U.S. Pat. No. 4,798,626.

BACKGROUND OF THE INVENTION

A safe, simple method of plating metallic items with silver has long been the goal of a variety of processes. Once plated, the silver is exposed to atmospheric sulfur dioxide, forming a yellow film of tarnish on the surface of the silver plated item which eventually turns black unless removed by polishing. Unfortunately, each time an item is polished to remove tarnish, some of the silver plating is also removed. The invention relates to non-toxic solutions and creams for plating silver onto metallic items such as copper, brass, bronze, nickel and most hard metals, as well as previously silver plated items. The inventive solutions and creams also simultaneously polish, as well as plate such items, thereby maintaining their silver plated appearance.

DESCRIPTION OF THE PRIOR ART

Various methods exist for the plating of metallic objects with silver. Electrolytic plating has long been used, but is impractical for consumer use. Furthermore, electrolytic plating reduces the value of antique silver plated items by destroying their patina. Electroless plating methods most commonly involve the use of compositions which contain a cyanide compound. Cyanide compounds present problems with toxicity which render them unsuitable for consumer use and require precautions for industrial use. Cyanide compounds are also potentially damaging to antique silver plated items, in that cyanide removes dirt (as opposed to tarnish) from the antique item. Other methods involve the use of formulations which can be explosive under certain conditions.

Some methods require cleaning of the object prior or subsequent to plating with silver. Such two-step procedures are inconvenient and timeconsuming. Still other methods require pretreatment such as activation or sensitization of the surface to be plated. Additional methods require the plating to be carried out at greater than ambient temperatures. All of these methods are impractical or timeconsuming for consumer use and involve extra expense for industrial use.

Once plated with silver, the removal of tarnish is periodically required. The polishing action, either mechanical or chemical, removes a portion of the silver from the object. Repeated polishing over a period of time will remove the silver completely, resulting in the exposure of the underlying base metal. A further difficulty is staining caused by the plating method.

U.S. Pat. No. 4,270,932 described a powdered non-toxic composition which in a single step polished and plated a silver plated item. However, in order to be used, the powder first had to be converted to a paste by the addition of water. Furthermore, the paste was not a stable liquid, but dried quickly, so that it could be applied only during a limited period of time. When applied, the paste formed small, gritty particles of silver which scratched the surface of the item. The paste also tended to leave black marks on the item, which had to be removed by conventional polishes, which in turn removed some of the silver just applied.

Users will find it more practical and convenient to use a composition in a ready to use form, such as a solution or cream, which may be applied directly, without any preparatory steps, to a metallic item, and which will not scratch the surface of the item. The solution or cream of this invention deposits a layer of silver to a base metal or to an item previously silver plated. The solution or cream also contains an additional ingredient so that the item is polished in the same step that it is silver plated.

SUMMARY OF THE INVENTION

Accordingly, it is an object of this invention to provide a non-toxic solution which may be applied directly to an item to simultaneously silver plate and polish the item. Another object of this invention is to provide a non-toxic solution which may be applied directly to a silver plated item to restore the silver removed by prior polishing steps and to retain its original look and patina.

A further object of this invention is to provide a non-toxic plating and polishing solution which will, even with a reduced silver component level, maintain the level of silver plating on an item; that is, the solution restores at least the amount of silver that is removed by the simultaneous polishing operation.

Another object of this invention is to provide a non-toxic solution which simultaneously plates and polishes a silver plated item while preventing indelible staining of surrounding objects or the user's hands during application of the solution to the item.

Yet another object of this invention is to provide a non-toxic cream which simultaneously plates and polishes a silver plated item. The silver component level can be adjusted so as to either maintain or restore the amount of silver plated on the item.

These solutions and creams may be applied in a single step at ambient temperatures, without electricity or the need for a separate cleaning step or pretreatment of the item to be plated, without the use of toxic cyanide compositions, without the formation of potentially explosive compounds, without the need for dissolving in water and without destroying the antique value of the item.

These objects are achieved by the novel solutions and creams which will now be described.

DETAILED DESCRIPTION OF THE INVENTION

Applicants have found that metallic items such as copper, brass, bronze, nickel and most hard metals can be plated with silver and polished by the use of aqueous solutions which contain a silver generating compound, a reducing compound for the silver generating compound, a polyoxyalkylene ester surfactant, a humectant, a polishing agent and a suspending agent.

The silver generating compound is selected from the group consisting of silver nitrate, silver oxide, silver chloride, silver carbonate and silver phosphate. In a preferred embodiment, silver nitrate is used. We have found that solutions with silver carbonate have the disadvantage of having a useful life span of only 2 or 3 days.

The reducing compound is selected from the group consisting of potassium hydrogen tartrate, sodium sulfite and sodium metabisulfate. In a preferred embodiment, potassium hydrogen tartrate is used. Sodium potassium tartrate should not be used, because it precipitates silver out of the solution (as well as creams), preventing the plating of the silver.

A variety of polyoxyalkylene ester compounds are commercially available for use as surfactants such as polyoxyethylene sorbitan fatty esters. In a preferred embodiment, the addition product of 20 moles of ethylene oxide with sorbitan oleate known as Tween 80 is used.

The humectant is selected from the group consisting of diethylene glycol, dipropylene glycol and triethylene glycol and serves as a wetting agent. In a preferred embodiment, dipropylene glycol is used. Two or more of these compounds may also be used in combination.

The polishing agent makes possible the simultaneous silver plating and polishing of an item. The polishing agent will serve to remove surface dirt and, for items already silver plated, will remove tarnish. The polishing agent will be a diatomaceous earth. Because the polishing agent will precipitate out of solution during storage, a compound is used to maintain the diatomaceous earth in solution. In a preferred embodiment, the diatomaceous earth is Kieselguhr. Particularly useful is the grade of Kieselguhr known as Dicalite 104. In a preferred embodiment, the suspending agent is propylene glycol. Although propylene glycol is a glycol, it is a far less effective wetting agent than those described previously and should not be used as the sole wetting agent in the solution. However, by maintaining the diatomaceous earth in solution, the propylene glycol serves to improve the polishing properties of the solution.

The above ingredients are mixed with water to form a solution. Preferably, the water is distilled or deionized. The solution is then packaged for sale to the user, who may apply the solution directly to the metallic item to be polished and plated without any mixing or handling steps.

When applied to a base metal such as copper, the novel solution quickly and easily lays down a layer of silver plating which is believed to bond directly to the surface of the object. This may be referred to as molecular plating, in contrast to electroplating. When applied to a previously silver plated object, the solution restores silver which has been removed by prior polishing. In either case, the solutions penetrate through any dirt or tarnish to act directly upon the surface of the object. The dirt or tarnish is simultaneously removed by the polishing agent in the solution. The surface need not be cleaned, pre-treated or sensitized in order for the plating of silver to take place.

In another embodiment of the invention, use of a smaller concentration of silver in the solution may be used to maintain, but not necessarily replenish, the amount of silver plating on an item. Such a solution will be less expensive, owing to the smaller amount of silver needed.

These solutions are easy to use and relatively inexpensive. However, the solution with the preferred silver generating compound, silver nitrate, may stain the user's hands and surrounding items. Staining may be prevented by the wearing of gloves by the user and by taking care not to bring the solution into contact with surrounding items.

Staining resulting from the use of silver nitrate may also be avoided through the use of an additional embodiment of the invention. The solution is prepared as previously described, except that silver lactate or silver acetate is used as the silver generating compound instead of silver nitrate. These compounds have been found to both generate the needed silver in a manner most similar to silver nitrate and to prevent staining. The use of silver lactate is preferred. If staining is not a major concern, then silver nitrate may be used because of its lower cost compared to silver lactate and silver acetate.

In another embodiment of the invention, the silver plating and polishing composition is in the form of a cream, rather than a solution. As with the solutions, the creams are non-toxic, non-explosive, require no preparative steps by the user and may be applied at ambient temperatures directly to the metallic object to be plated or to a previously silver plated object.

The creams contain a silver generating compound, a reducing compound for the silver generating compound, an emulsifier, a humectant, a polishing agent and water.

The silver generating compound is selected from the group consisting of silver nitrate, silver oxide, silver chloride, silver carbonate, silver lactate, silver acetate and silver phosphate. In a preferred embodiment, silver nitrate is used. We have found that, as with solutions, creams with silver carbonate have the disadvantage of a reduced useful life. Silver lactate or silver acetate may be used to prevent staining. However, use of these more expensive silver generating and anti-staining compounds is not necessary if sodium chloride is included in the cream formulation. Sodium chloride prevents staining with creams, but should not be used in solutions because it impedes the plating of silver in solutions.

The reducing compound is selected from the group consisting of potassium hydrogen tartrate, sodium sulfite, sodium metabisulfate and sodium thiosulfate. Sodium thiosulfate may be used because in creams it does not have the instability problems associated with use in solutions. In a preferred embodiment, potassium hydrogen tartrate is used.

Alcohols are used as emulsifiers for the cream. In particular, a variety of long chain alcohols may be used, such as cetyl alcohol, the high molecular weight alcohol which is 10% sulfated known as Lanette Wax SX, tetradecyl trimethyl ammonium bromide (known as cetrimide) or the cetyl alcohol condensed with 20 ethylene oxide units known as Empilan KM20. In a preferred embodiment, Lanette Wax SX is used.

The humectant is selected from the group consisting of diethylene glycol, dipropylene glycol and triethylene glycol and serves as a wetting agent. In a preferred embodiment, dipropylene glycol is used. Two or more of these compounds may also be used in combination.

The use of a diatomaceous earth as a polishing agent makes possible the simultaneous silver plating and polishing of an item. In a preferred embodiment, the diatomaceous earth is Kieselguhr or red ferric oxide. In a particularly preferred embodiment, the diatomaceous earth is Kieselguhr. Calcium carbonate, also known as whiting, produces poor results, possibly due to imcompatibility with potassium hydrogen tartrate. Unlike the solutions described previously, suspending agents are not needed for the creams.

The above ingredients are mixed with water to form a cream. Preferably, the water is distilled or deionized. The cream is then packaged for sale to the user, who may apply the cream directly to the metallic object to be plated or to a previously silver plated object without any mixing or handling steps.

When the creams are applied to the metal, the surface will become blackened. However, the blackening is not a stain and is removed by polishing, so that the silvered surface becomes visible. In some instances, blackening may be eliminated even prior to polishing by the inclusion of sodium chloride in the cream formulation.

In a further embodiment of the invention, the amount of the silver generating compound in the cream may be reduced so as to maintain, but not necessarily replenish, the amount of silver plating on an item.

In yet another embodiment of this invention, it has been found quite unexpectedly that a non-toxic water soluble silver salt, when combined with water alone to produce a solution, will generate and deposit silver so as to plate the metallic items described earlier in this application. Although many different types of reducing compounds may be used in silver plating, including the preferred compounds described earlier in this application, it has been found that reducing compounds are basically not necessary to achieve silver plating.

Examples of water soluble silver salts that may be used include silver nitrate and silver sulfate. In a preferred embodiment, silver nitrate is used. Silver lactate or silver acetate, which are also water soluble, may be used in place of silver nitrate to prevent staining. Because the solutions are dilute, the silver salts need not be highly soluble in water to be effective.

The foregoing solutions of water soluble silver salts and water have value in silver plating. However, in many instances, the user will find it more desirable to apply solutions which contain polishing ingredients, as well as additional ingredients to further facilitate the plating. The user may also prefer the convenience of creams which contain polishing agents, emulsifiers and additional ingredients to further facilitate the silver plating.

Therefore, this embodiment of the invention also provides for solutions and creams which simultaneously silver plate and polish metallic items without the need for reducing compounds. The solutions and creams are prepared and applied to base metals or tarnished silver plated items in the same manner as previously described for the solutions and creams containing the reducing compounds.

The deletion of one ingredient from the compositions—the reducing compound—and its replacement by water reduces the cost without significantly affecting the quality of the silver plating and polishing. It has also been found that deletion of the reducing compound increases the shelf-life of the solutions. It is thought that the precipitation of silver out of the solutions which can occur over extended storage periods is due to the presence of reducing compounds.

The silver plating and polishing aqueous solutions in this embodiment of the invention contain a water soluble silver salt, a polyoxyalkylene ester surfactant, a humectant, a polishing agent, a suspending agent and water. The particular compounds used in the solutions are selected from those described earlier in this application. Maintenance solutions using a smaller concentration of water soluble silver salts may be used to maintain, but not necessarily replenish, the amount of silver plating on an item. These maintenance solutions, as well as antistain solutions, may also be prepared without reducing compounds, again using the particular compounds selected from those described earlier in this application.

The silver plating and polishing creams in this embodiment of the invention contain a water soluble silver salt, an emulsifier, a humectant, a polishing agent and water. The particular compounds used in the creams are selected from those described earlier in this application. Maintenance creams, without reducing compounds, may also be prepared, again using the particular compounds selected from those described earlier in this application.

The following examples present illustrative but non-limiting embodiments of the present invention.

EXAMPLE 1

A solution was prepared from the following components, all parts by weight:

| | |
|---|---|
| Silver nitrate | 1.8 |
| Potassium hydrogen tartrate | 7.0 |
| Tween 80 | 1.0 |
| Dipropylene glycol | 2.0 |
| Triethylene glycol | 1.0 |
| Dicalite 104 | 14.0 |
| Propylene glycol | 2.0 |
| Water | 71.2 |

The solution was applied to a copper surface with a cloth and worked into the surface. After drying, the surface was gently polished with a soft cloth. The solution produced excellent silvering and polishing of the surface.

EXAMPLE 2

A solution was prepared from the following components, all parts by weight:

| | |
|---|---|
| Silver nitrate | 2.0 |
| Potassium hydrogen tartrate | 13.5 |
| Tween 80 | 1.0 |
| Dipropylene glycol | 2.0 |
| Dicalite 104 | 16.5 |
| Propylene glycol | 3.0 |
| Water | 62.0 |

The solution was applied to a copper surface with a cloth and worked into the surface. After drying, the surface was gently polished with a soft cloth. The solution produced excellent silvering and polishing of the surface.

EXAMPLE 3

A solution was prepared from the following components, all parts by weight:

| | |
|---|---|
| Silver lactate | 1.8 |
| Potassium hydrogen tartrate | 6.0 |
| Tween 80 | 1.0 |
| Dipropylene glycol | 2.0 |
| Dicalite 104 | 17.0 |
| Propylene glycol | 3.0 |
| Water | 69.2 |

The solution was applied to a copper surface with a cloth and worked into the surface. After drying, the surface was gently polished with a soft cloth. The solution produced excellent silvering of the copper and did not stain the skin.

EXAMPLE 4

A solution was prepared from the following components, all parts by weight:

| | |
|---|---|
| Silver acetate | 0.5 |
| Potassium hydrogen tartrate | 3.5 |

-continued

| | |
|---|---|
| Tween 80 | 0.5 |
| Dipropylene glycol | 2.0 |
| Dicalite 104 | 17.5 |
| Propylene glycol | 3.0 |
| Water | 73.0 |

The solution was applied to a copper surface with a cloth and worked into the surface. After drying, the surface was gently polished with a soft cloth. The solution produced excellent silvering of the copper and did not stain the skin.

EXAMPLE 5

A solution was prepared from the following components, all parts by weight:

| | |
|---|---|
| Silver nitrate | 0.5 |
| Potassium hydrogen tartrate | 3.5 |
| Tween 80 | 1.0 |
| Dipropylene glycol | 2.0 |
| Dicalite 104 | 12.0 |
| Propylene glycol | 3.0 |
| Water | 78.0 |

This solution, which contained less silver generating compound than Example 1, was applied to a previously silver plated surface with a cloth and worked into the surface. After drying, the surface was gently polished with a soft cloth. The solution polished the surface and added at least as much silver as was removed by polishing, thereby maintaining the original amount of silver plating on the item.

EXAMPLE 6

A cream was prepared from the following components, all parts by weight:

| | |
|---|---|
| Silver nitrate | 5.3 |
| Potassium hydrogen tartrate | 39.4 |
| Lanette wax SX | 7.5 |
| Dipropylene glycol | 4.0 |
| Kieselguhr | 5.3 |
| Water | 38.5 |

The cream was applied as a thin layer to the metal and allowed to stand for 30 seconds. The surface was rubbed with a cloth for 30 seconds. A second application of the cream was made and the procedure repeated. The cream provided very good silvering. The surface blackened on contact with the cream. However, the blackening was not a stain, and was easily removed in the course of polishing.

EXAMPLES 7-9

The following creams were prepared as follows, all parts by weight:

| | |
|---|---|
| Example 7 | |
| Silver nitrate | 4.0 |
| Potassium hydrogen tartrate | 29.8 |
| Cetyl alcohol | 7.0 |
| Empilan KM20 | 1.7 |
| Dipropylene glycol | 4.0 |
| Kieselguhr | 7.9 |
| Water | 45.6 |
| Example 8 | |
| Silver nitrate | 4.0 |

-continued

| | |
|---|---|
| Potassium hydrogen tartrate | 30.0 |
| Cetyl alcohol | 6.8 |
| Cetrimide | 0.7 |
| Dipropylene glycol | 5.5 |
| Kieselguhr | 5.0 |
| Water | 48.0 |
| Example 9 | |
| Silver nitrate | 5.8 |
| Potassium hydrogen tartrate | 42.3 |
| Lanette wax SX | 7.6 |
| Dipropylene glycol | 4.0 |
| Red ferric oxide | 1.5 |
| Water | 38.8 |

Each of these creams was applied and polished following the procedure of Example 6, and similar results were obtained.

EXAMPLE 10

A cream was prepared from the following components, all parts by weight:

| | |
|---|---|
| Silver nitrate | 5.0 |
| Potassium hydrogen tartrate | 38.7 |
| Lanette wax SX | 7.5 |
| Dipropylene glycol | 4.0 |
| Red ferric oxide | 1.3 |
| Sodium chloride | 5.0 |
| Water | 38.5 |

The cream was applied and polished following the procedure of Example 6. The cream provided very good silvering and did not cause blackening of the surface, even prior to polishing.

EXAMPLE 11

A cream was prepared from the following components, all parts by weight:

| | |
|---|---|
| Silver nitrate | 5.1 |
| Potassium hydrogen tartrate | 35.9 |
| Lanette wax SX | 7.5 |
| Dipropylene glycol | 4.0 |
| Kieselguhr | 3.9 |
| Sodium chloride | 5.1 |
| Water | 38.5 |

The cream was applied and polished following the procedure of Example 6, and results similar to Example 10 were obtained.

EXAMPLE 12

A cream was prepared from the following components, all parts by weight:

| | |
|---|---|
| Silver nitrate | 1.0 |
| Potassium hydrogen tartrate | 43.0 |
| Lanette wax | 7.5 |
| Dipropylene glycol | 4.0 |
| Kieselguhr | 3.5 |
| Sodium chloride | 2.5 |
| Water | 38.5 |

This cream, which contained less silver generating compound than Example 6, was applied to a previously silver plated surface and polished following the procedure of Example 6. The cream polished the surface and added at least as much silver as was removed by polishing, thereby maintaining the original amount of silver plating on the item.

EXAMPLE 13

A solution was prepared from 1.8 parts by weight silver nitrate and 98.2 parts by weight of water. The solution was applied to a polished copper surface with a cloth and worked into the surface. After drying, the surface was gently polished with a soft cloth. The solution produced satisfactory silvering of the surface.

EXAMPLE 14

A solution was prepared from 1.8 parts by weight silver lactate and 98.2 parts by weight of water. The solution was applied to a polished copper surface with a cloth and worked into the surface. After drying, the surface was gently polished with a soft cloth. The solution produced satisfactory silvering of the surface.

EXAMPLE 15

A solution was prepared from the following components, all parts by weight:

| | |
|---|---|
| Silver nitrate | 1.8 |
| Tween 80 | 1.0 |
| Dipropylene glycol | 2.0 |
| Dicalite 104 | 14.0 |
| Water | 81.2 |

The solution was applied to a copper surface with a cloth and worked into the surface. After drying, the surface was gently polished with a soft cloth. The solution produced excellent silvering and polishing of the surface.

We claim:

1. A non-toxic, anti-stain solution for silver plating a base metal or for restoring silver removed from a silver plated article by previous polishing comprising effective amounts of: (1) a water soluble silver salt as a silver generating compound selected from the group consisting of silver lactate and silver acetate; and (2) water, such solution in the absence of a reducing compound for said silver salt.

2. The solution of claim 1 wherein the water soluble silver salt is silver lactate.

3. A non-toxic solution for polishing and silver plating a base metal or for restoring silver removed from a silver plated article by previous polishing comprising effective amounts of: (1) a water soluble silver salt as a silver generating compound selected from the group consisting of silver nitrate and silver sulfate; (2) a polyoxyalkylene ester surfactant; (3) a humectant selected from the group consisting of diethylene glycol, dipropylene glycol and triethylene glycol; (4) a diatomaceous earth as a polishing component; and (5) water, such solution in the absence of a reducing compound for said silver salt.

4. The solution of claim 3 wherein the water soluble salt is silver nitrate.

5. The solution of claim 3 wherein the polyoxyalkylene ester surfactant is the addition product of 20 moles of ethylene oxide with sorbitan oleate.

6. The solution of claim 3 wherein the humectant is dipropylene glycol.

7. The solution of claim 3 wherein the diatomaceous earth is Kieselguhr and which further comprises an effective amount of a compound to maintain the Kieselguhr in suspension in the solution.

8. A non-toxic, anti-stain solution for polishing and silver plating a base metal or for restoring silver removed from a silver plated article by previous polishing comprising effective amounts of: (1) a water soluble silver salt as a silver generating compound selected from the group consisting of silver lactate and silver acetate; (2) a polyoxyalkylene ester surfactant; (3) a humectant selected from the group consisting of diethylene glycol, dipropylene glycol and triethylene glycol; (4) a diatomaceous earth as a polishing component; and (5) water, such solution in the absence of a reducing compound for said silver salt.

9. The solution of claim 8 wherein the water soluble silver salt is silver lactate.

10. The solution of claim 8 wherein the polyoxyalkylene ester surfactant is the addition product of 20 moles of ethylene oxide with sorbitan oleate.

11. The solution of claim 8 wherein the humectant is dipropylene glycol.

12. The solution of claim 8 wherein the diatomaceous earth is Kieselguhr and which further comprises an effective amount of a compound to maintain the Kieselguhr in suspension in the solution.

13. A non-toxic solution for polishing and maintaining the amount of silver on a silver plated article, by restoring at least the amount of silver removed by that polishing, comprising effective amounts of: (1) a water soluble silver salt as a silver generating compound selected from the group consisting of silver nitrate, silver lactate, silver acetate and silver sulfate; (2) a polyoxyalkylene ester surfactant; (3) a humectant selected from the group consisting of diethylene glycol, dipropylene glycol and triethylene glycol; (4) a diatomaceous earth as a polishing component; and (5) water, such solution in the absence of a reducing compound for said silver salt.

14. The solution of claim 13 wherein the water soluble silver salt is selected from the group consisting of silver nitrate and silver lactate.

15. The solution of claim 13 wherein the polyoxyalkylene ester surfactant is the addition product of 20 moles of ethylene oxide with sorbitan oleate.

16. The solution of claim 13 wherein the humectant is dipropylene glycol.

17. The solution of claim 13 wherein the diatomaceous earth is Kieselguhr and which further comprises an effective amount of a compound to maintain the Kieselguhr in suspension in the solution.

18. A non-toxic cream for polishing and silver plating a base metal or for restoring silver removed from a silver plated article by previous polishing comprising effective amounts of: (1) a water soluble silver salt as a silver generating compound selected from the group consisting of silver nitrate, silver lactate, silver acetate and silver sulfate; (2) an alcohol as an emulsifier; (3) a humectant selected from the group consisting of diethylene glycol, dipropylene glycol and triethylene glycol; (4) a diatomaceous earth as a polishing component; and (5) water, such cream in the absence of a reducing compound for said silver salt.

19. The cream of claim 18 wherein the water soluble silver salt is silver lactate or silver acetate.

20. The cream of claim 18 which further comprises sodium chloride.

21. The cream of claim 20 wherein the water soluble silver salt is silver nitrate.

22. The cream of claim 20 wherein the humectant is dipropylene glycol.

23. The cream of claim 20 wherein the diatomaceous earth is Kieselguhr.

24. A non-toxic cream for polishing and maintaining the amount of silver on silver plated article, by restoring at least the amount of silver removed by that polishing, comprising effective amounts of: (1) a water soluble silver salt as a silver generating compound selected from the group consisting of silver nitrate, silver lactate, silver acetate and silver sulfate; (2) an alcohol as an emulsifer; (3) a humectant selected from the group consisting of diethylene glycol, dipropylene glycol and triethylene glycol; (4) a diatomaceous earth as polishing component; and (5) water, such cream in the absence of a reducing compound for said silver salt.

25. The cream of claim 24 wherein the water soluble salt is silver lactate or silver acetate.

26. The cream of claim 20 which further comprises sodium chloride.

27. The cream of claim 26 wherein the water soluble silver salt is silver nitrate.

28. The cream of claim 26 wherein the humectant is dipropylene glycol.

29. The cream of claim 26 wherein the diatomaceous earth is Kieselguhr.

30. The solution of claim 7 wherein the compound to maintain the Kieselguhr in suspension is propylene glycol.

31. The solution of claim 12 wherein the compound to maintain the Kieselguhr in suspension is propylene glycol.

32. The solution of claim 17 wherein the compound to maintain the Kieselguhr in suspension is propylene glycol.

* * * * *